US006205977B1

(12) United States Patent
Hirakata et al.

(10) Patent No.: US 6,205,977 B1
(45) Date of Patent: Mar. 27, 2001

(54) FUEL INJECTION CONTROL APPARATUS OF MULTICYLINDER INTERNAL COMBUSTION ENGINE

(75) Inventors: Yoshiaki Hirakata; Tatsuo Hayashi; Hiroshi Tanaka, all of Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/329,213

(22) Filed: Jun. 10, 1999

(30) Foreign Application Priority Data

Jun. 10, 1998 (JP) ..... 10-161573

(51) Int. Cl.[7] ..... F02M 7/00
(52) U.S. Cl. ..... 123/436; 123/478
(58) Field of Search ..... 123/436, 478, 123/486, 480

(56) References Cited

U.S. PATENT DOCUMENTS 5,578,749 * 11/1996 Mogaki ..... 123/478
5,615,657 * 4/1997 Yoshizawa ..... 123/478
5,634,448 * 6/1997 Shinogle et al. ..... 123/478
5,758,308 * 5/1998 Maki et al. ..... 123/478
5,832,901 * 11/1998 Yoshida et al. ..... 123/478
5,836,287 * 11/1998 Yano et al. ..... 123/478
6,041,757 * 3/2000 Kdota ..... 123/478

* cited by examiner

*Primary Examiner*—John Kwon
(74) *Attorney, Agent, or Firm*—Birch, Stewart, Kolasch & Birch, LLP

(57) ABSTRACT

To provide a fuel injection control apparatus of a multicylinder internal combustion engine capable of adjusting the quantity of fuel injection between cylinders by use of the fewest possible number of rheostats. The quantity of fuel to be injected into each cylinder of an internal combustion engine is calculated. Any one of a plurality of cylinders in the multicylinder internal combustion engine is selectively designated in accordance with an output of a first variable control section. An adjusting data indicating the amount of adjustment for the fuel injection quantity is generated in accordance with the output of a second variable control section and the quantity of fuel injection is corrected in accordance with the adjustment data when the fuel injection quantity corresponding to one cylinder designated in the mode of fuel adjustment between cylinders is calculated, so that only the corrected quantity of fuel injection will be injected to one cylinder thus designated.

17 Claims, 4 Drawing Sheets

CYLINDER m

| | $Ti_{IMA}(m)$ |
|---|---|
| 1 | T1 |
| 2 | T2 |
| 3 | T3 |
| 4 | T4 |

FUEL INJECTION CONTROL APPARATUS OF MULTICYLINDER INTERNAL COMBUSTION ENGINE

BACKGROUND OF THE INVENTION

1. Field of the Invention

The present invention relates to a fuel injection control apparatus of a multicylinder internal combustion engine and, more particularly, to a fuel injection control apparatus having a function to regulate the quantity of fuel injection between cylinders.

2. Description of the Related Art

A multicylinder internal combustion engine provided with an injector for each cylinder has a fuel injection control apparatus for injecting fuel of a calculated injection quantity by means of the injector to a corresponding cylinder.

In this case, however, there will take place an injection variation in the fuel injected by the injector, that is, a variation in the engine power with a difference in combustion in each cylinder of the engine itself, notwithstanding the same quantity of fuel injection calculated by the fuel injection control apparatus. In the related art fuel injection control apparatus, therefore, there is provided, by each cylinder, a variable control section, such as a rheostat, for adjusting the fuel injection quantity between cylinders for the purpose of correcting the engine output variation. Each variable control section is so adapted as to regulate the fuel injection quantity, at the time of calculation of the fuel injection quantity, by an amount corresponding to the amount of the operation effected at the variable control section when a user, a maintenance engineer for example, manipulates a controller on some variable control section during an engine idling operation.

In the related art fuel injection control apparatus, however, the variable control section is provided by each cylinder for the purpose of adjusting the fuel injection quantity between cylinders as previously stated. Therefore, the related art apparatus presents such a problem that the component count will increase and moreover it will become difficult to design an actual mounting layout.

SUMMARY AND OBJECTS OF THE INVENTION

An object of the present invention, therefore, is to provide a fuel injection control apparatus of a multicylinder internal combustion engine that is capable of adjusting the quantity of fuel to be injected between cylinders, from the fewest possible variable control sections.

The fuel injection control apparatus of the present invention is for controlling the quantity of fuel to be injected into a cylinder of a multicylinder internal combustion engine, which comprises a fuel injection quantity calculating means for calculating the quantity of fuel to be injected into each cylinder of the internal combustion engine in accordance with engine operation parameters. A cylinder designating means is provided for selectively designating any one of the multicylinders in accordance with output of a first variable control section. An adjustment quantity designating means is provided for generating fuel adjusting data which indicates the amount of adjustment of the fuel injection in accordance with the output of a second variable control section. A fuel injection quantity correcting means is operatively connected for correcting the quantity of fuel to be injected in accordance with the fuel adjusting data generated by the adjustment quantity designating means. The fuel injection quantity is corrected when the fuel injection quantity has been calculated by the fuel injection quantity calculating means for one cylinder designated by the cylinder designating means in a mode of fuel adjustment between cylinders. A means is provided for injecting fuel into one designated cylinder when the quantity of the fuel has been corrected by the injection quantity correcting means.

According to the fuel injection control apparatus of the multicylinder internal combustion engine of the present invention, the designated cylinder is changed in accordance with the operation of the first variable control section, and the amount of adjustment of fuel injection indicated by the adjusting data is also changed in accordance with the operation of the second variable control section. In the mode of fuel adjustment between cylinders, therefore, it is possible to set the amount of adjustment of the fuel injection into all cylinders simply by the two variable control sections. The two variable control sections correct the quantity of fuel injection corresponding to one cylinder designated at the time of the mode of the fuel adjustment between cylinders in accordance with the adjusting data. Consequently, the fuel injection quantity between cylinders can be adjusted by means of the least possible number of variable control sections.

Furthermore, the fuel injection control apparatus of a multicylinder internal combustion engine according to the present invention is characterized in that a means is further provided for storing in a memory adjusting data as a data map corresponding to one cylinder designated by the cylinder designating means at the time the adjusting data is gained. The data map is generated by the adjustment quantity designating means in the mode of fuel adjustment between cylinders. The injection quantity correcting means reads, from the data map, the adjusting data corresponding to each cylinder in an engine operation mode than the other of fuel adjustment between cylinders, thereby correcting the fuel injection quantity calculated by the fuel injection quantity calculating means in accordance with the adjusting data thus read.

According to the fuel injection control apparatus of the present invention thus constituted, the adjusting data obtained by each cylinder in the mode of fuel adjustment between cylinders can be stored by each cylinder as a data map. Therefore, the adjusting data gained in the mode of fuel adjustment between cylinders can be properly reflected in terms of the quantity of fuel injection into each cylinder in a subsequent engine operation mode.

Furthermore, the fuel injection control apparatus of the multicylinder internal combustion engine according to the present invention is characterized by the provision of an indicator which indicates one cylinder designated by the cylinder designating means in the mode of fuel adjustment between cylinders when an adjusting data corresponding to the designated one cylinder is given by the adjustment quantity designating means.

According to the fuel injection control apparatus of the present invention having the above-described constitution, the operator can see which cylinder is under adjustment and accordingly can easily perform the adjusting operation.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Preferred embodiments of the fuel injection control apparatus according to the present invention will hereinafter be explained in detail with reference to the accompanying drawings.

Figure 1:
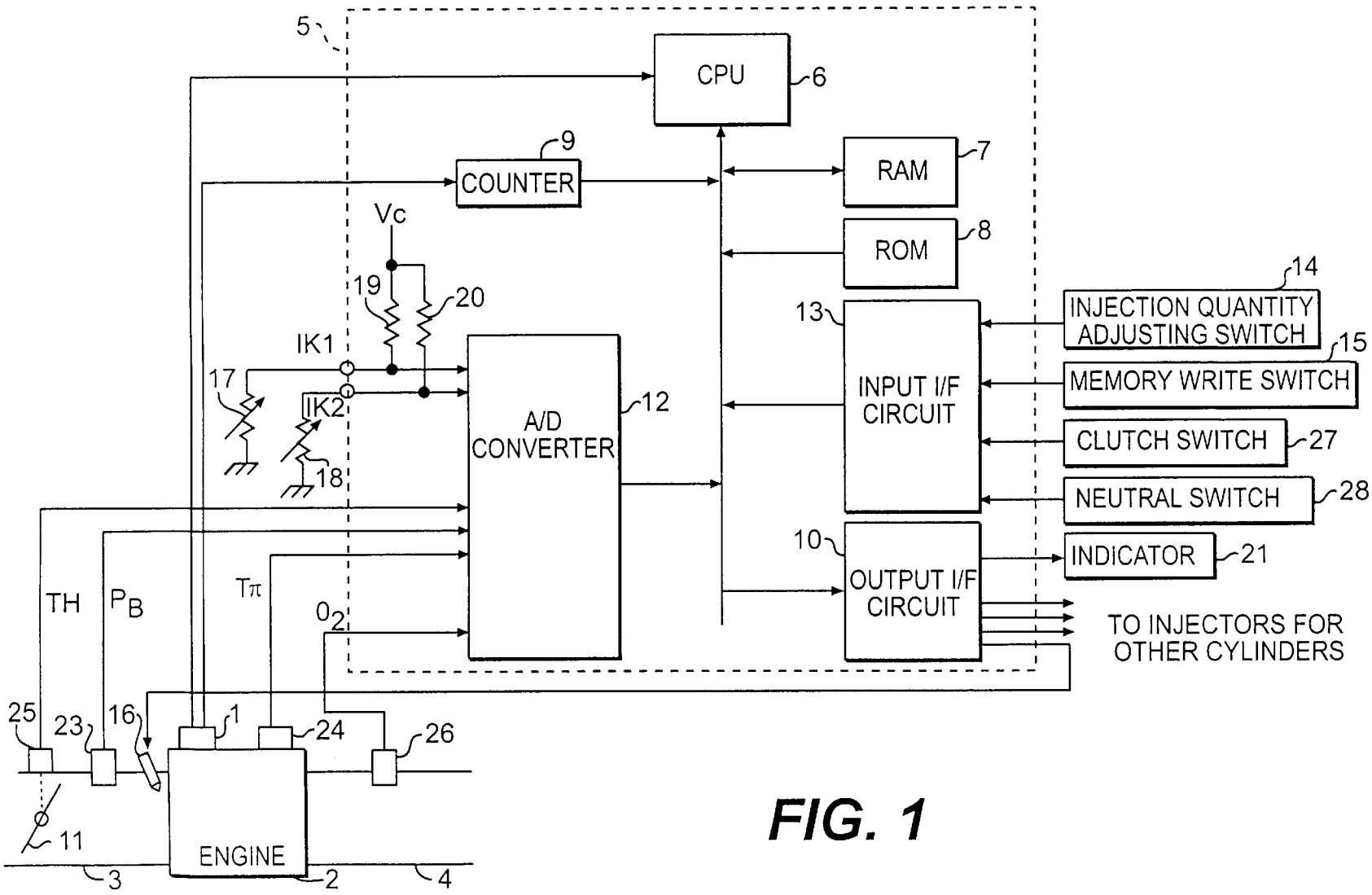
FIG. 1 is a block diagram showing an embodiment of the present invention.

FIG. 1 shows an engine control system of a four-cylinder internal combustion engine of the present invention. In the engine control system, a crank angle sensor 1 comprises a rotor and an electromagnetic pickup (both not shown). In the outer periphery of the rotor are provided projections made of a magnetic material, which are continuously formed at a predetermined angle, e.g., at intervals of 30 degrees. The electromagnetic pickup is arranged in the vicinity of the outer periphery of the rotor. The rotor is designed to turn through a specific angle in interlock with the rotation of an unillustrated crankshaft of an engine 2, to thereby generate a crank pulse from the electromagnetic pickup by each rotation through the specific angle. The crank angle sensor 1 generates a tdc signal at the TDC of a piston of each cylinder and a reference position signal by each 720-degree rotation of the crankshaft.

The crank angle sensor is connected to an ECU5 (Electronic Control Unit). The ECU 5 includes CPU 6, RAM 7, ROM 8, counter 9, output interface (I/F) circuit 10, A/D converter 12, and an input interface (I/F) circuit 13. The counter 9 carries out interrupt handling in response to a reference position signal and a TDC signal. The CPU 6, RAM 7, ROM 8, counter 9, I/O interface circuit 10, A/D converter 12, and the input interface circuit 13 are connected to a common bus.

Connected to the input interface circuit 13 is a neutral switch 28 for detecting that an injection quantity adjusting switch 14 which commands adjustment of the quantity of fuel injection, a memory write switch 15 which commands data memory into the ROM 8, and a neutral switch 28 which detects that a clutch switch 27 for detecting the release of an unillustrated clutch and an unillustrated transmission are in neutral positions. The input interface circuit 13 serves to detect on-off operation of these switches, to thereby supply a result of detection as data to the CPU 6.

The A/D converter 12 functions to convert, into digital signals, analog signals from a plurality of sensors for sensing such engine operation parameters as the intake pipe internal pressure $P_B$, coolant temperature Tw, throttle angle TH, oxygen concentration $O_2$ in exhaust emissions, etc. The intake pipe internal pressure $P_B$ is detected by an intake pipe internal pressure sensor 23 mounted in an intake pipe 3 located on a downstream side of a throttle valve 11. The coolant temperature Tw is sensed by means of a coolant temperature sensor 24. The throttle valve angle TH is sensed by means of a throttle angle sensor 25.

Furthermore, the oxygen concentration $O_2$ in the exhaust emissions is sensed by an oxygen concentration sensor 26 inserted in an exhaust pipe 4. The oxygen concentration sensor 26 is a binary output type oxygen concentration sensor which generates different levels of an air-fuel ratio on the rich and lean sides in relation to a stoichometric air-fuel ratio as a threshold value.

Two rheostats 17 and 18 are removably connected to the A/D converter 12 through terminals IN1 and IN2. The rheostat 17 is for adjusting the quantity of fuel to be injected. The rheostat 18 is for designating a cylinder, the resistance value of which can be changed by the operator by operating each controller. The rheostats 17 and 18 are each applied with the voltage Vc via the resistors 19 and 20 respectively as shown in FIG. 1, and the voltage corresponding to the resistance value of each of the rheostats 17 and 18 is supplied to the A/D converter 12. In this preferred embodiment, rheostats 17 and 18 can be used as first and second variable control devices, respectively.

The CPU 6, executing the fuel injection control routine pre-stored in the ROM 8, determines the fuel injection time Tout for each cylinder by using the engine operation parameters and the engine speed Ne stated above. The fuel injection time Tout is given by, for instance, the following equation.

$$Tout = Ti \times K_{02} \times K_{WOT} \times K_{TW} \times K_{TA} + T_{ACC} + T_{DEC} + TilMA(m) \quad \text{Equation 1}$$

where Ti is a reference fuel injection time, or the reference control value of the air-fuel ratio, which is determined by data map retrieval from the ROM 8 in accordance with the engine speed Ne and the intake pipe internal pressure $P_B$; $T_{02}$ is an air-fuel ratio correction factor calculated in the air-fuel ratio feedback control; $K_{WOT}$ is a fuel enrichment correction factor during high load, for instance when the throttle valve is wide open; $K_{TW}$ is a coolant temperature correction factor to be set in accordance with the coolant temperature TW; $K_{TA}$ is an intake air temperature correction factor to be set in accordance with the intake air temperature $T_A$, $T_{Acc}$ is an enrichment value for acceleration to be set in accordance with a degree of acceleration of the engine speed Ne; and $T_{DEC}$ is a reduction value for deceleration in accordance with a degree of decrease in the engine speed Ne. TiIMA(m) is a fuel correction value between cylinders for adjusting the quantity of fuel injection between the cylinders, which is set by a value according to the control of the rheostat 17 for the adjustment of a later-descnibed fuel injection quantity. Correction factors $K_{WOT}$, $K_{TW}$, and $K_{TA}$, enrichment value for acceleration $T_{ACC}$, reduction value for deceleration $T_{DEC}$, and fuel correction value between cylinders TiIMA(m) are determined by data map retrieval from the ROM 8. The fuel correction value between cylinders TiIMA(m) is determined for the TiIMA(m) data map by each cylinder m. The TiIMA(m) data map is renewed by the later-described storing operation. Thus, a fuel injection instruction is generated from the CPU 6 to effect fuel injection for a period of the fuel injection time Tout thus determined, thereby generating an injector drive instruction from the CPU 6.

The output interface circuit 10 drives one of four injectors (three other injectors are not depicted) for the cylinder m in accordance with an injector drive instruction from the CPU 6. Each injector is inserted in the intake pipe 3 in the vicinity of the intake port 6 of each cylinder of the internal combustion engine, to thereby inject fuel when the injector is driven. Furthermore, the indicator 21 including light-emitting diodes is connected to the output interface circuit 10.

When the engine is running within such an operation range as to perform air-fuel ratio feedback control, the output level of the oxygen concentration sensor 26 is used to determine whether or not the air-fuel ratio of a mixture supplied is richer or leaner than the stoichometric air fuel ratio. The air-fuel ratio correction factor $K_{02}$ is set in accordance with a result of the determination. The fuel injection time Tout is calculated by each cylinder from the equation by using the thus set air-fuel ratio correction factor $K_{02}$. Therefore, the fuel is injected into the engine 2 for the fuel injection time Tout; thus fuel combustion takes place within the engine body. Exhaust emissions thus generated as a result of the combustion are discharged, and consequently the oxygen concentration in the east emissions is sensed by means of the oxygen concentration sensor 26. Repeating this operation can effect feedback control of the air-fuel ratio of the supplied mixture to the stoichometric air fuel ratio.

In the meantime, when there exists no operation range within which the air-fuel ratio feedback control is effected, the air-fuel ratio correction factor $K_{02}$ is set to 1 regardless of the output level of the oxygen concentration sensor 26, and is used in the calculation of the fuel injection time Tout. Thus the air-fuel ratio feedback control is ceased to allow the open loop control of the air-fuel ratio.

Next, the fuel injection quantity adjusting operation for adjusting the quantity of fuel injection between cylinders will be explained. The fuel injection quantity adjusting operation is done by, for instance, the injection quantity adjusting switch 14 in the adjusting mode for adjusting fuel injection quantity between cylinders.

Figure 2:
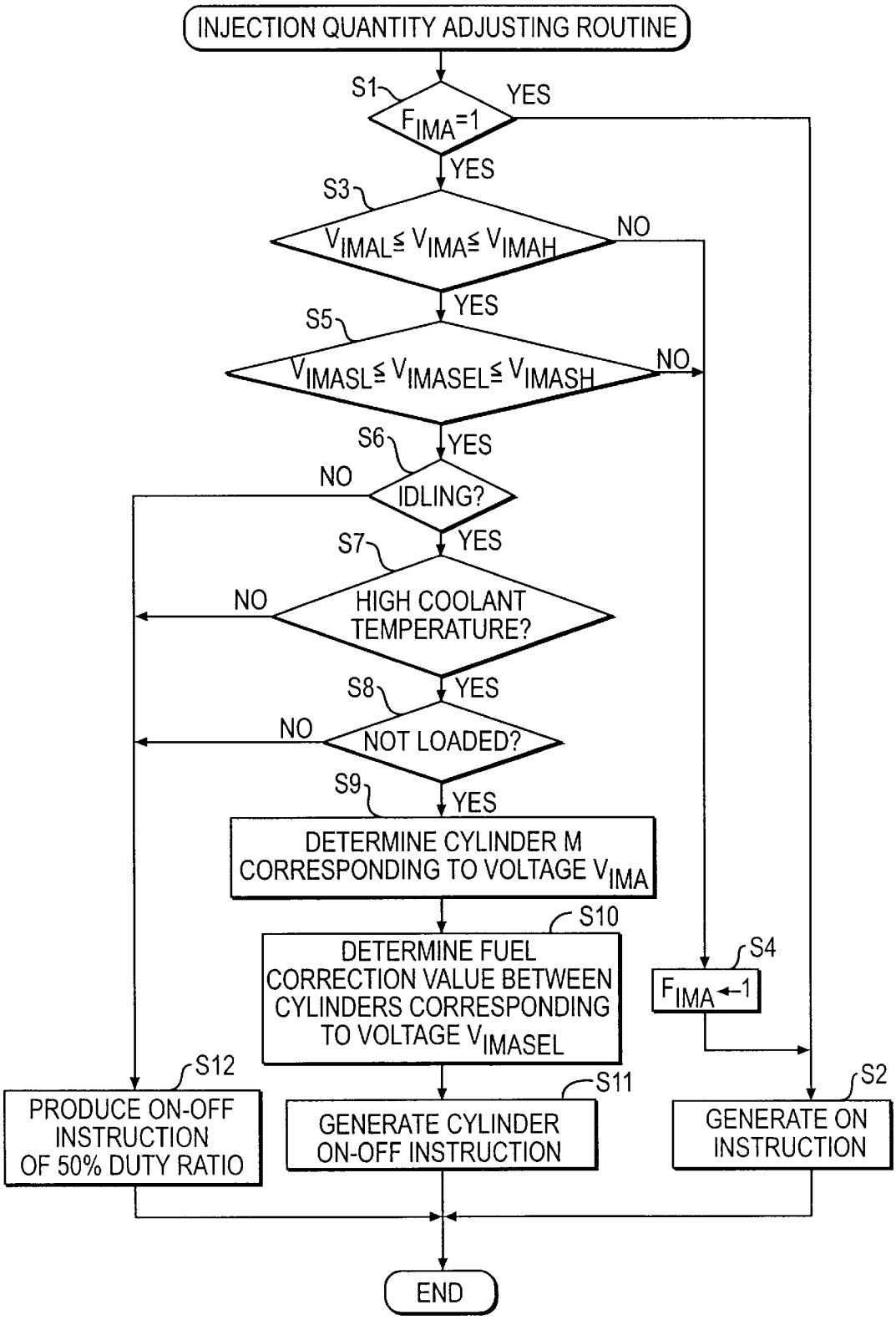
FIG. 2 is a flowchart showing an injection quantity adjusting routine.

In the fuel injection quantity adjustment, the CPU 6 determines first whether or not the adjustment enabling flag FIMA has been set at 1 as shown in FIG. 2 (at Step S1). This determination is effected because the rheostats 17 and 18 must be in connection with the connecting terminals IN1 and IN2 to adjust the quantity of fuel injection between cylinders. The initial value of the adjustment enabling flag FIMA is zero during the period of startup of the engine 2 when the ECU 5 is reset. The initial value, when FIMA=1, means that it has been confirmed, at the subsequent step S3 or S5, that the rheostats 17 and 18 are not connected to the connecting terminals IN1 and IN2 or no proper voltage is being applied to the connecting terminals IN1 and IN2. When FIMA=1, an indicator ON instruction for turning on the indicator 21 is fed to the output interface circuit 10 (at Step S2). The output interface circuit 10 turns on the indicator 21 according to the indicator ON instruction, thus informing the operator that the fuel injection quantity adjustment cannot be made.

When FIMA=0 at the step S1, whether the voltage $V_{IMA}$ at the connecting terminal IN1 is greater than or equal to and less than or equal to the lower limit value $V_{IMAL}$ the upper limit value $V_{IMAH}$ is determined (at Step S3). When $V_{IMAL} \leqq V_{IMA} \leqq V_{IMAH}$ is satisfied, it is indicated that the quantity of fuel injection is within an adjustable range, in which the quantity of fuel injection can be adjusted by operating the rheostat 17 for adjusting the quantity of fuel injection. However, when $V_{IMA} < V_{VIMAL}$ or $V_{IMA} > V_{IMAH}$ is satisfied, it indicates that the quantity of fuel range is outside of the adjustable range. In this case, the quantity of the fuel injection cannot be adjusted by operating the rheostat 17 for adjusting the quantity of fuel injection. Therefore, the adjustment enabling flag FIMA is set to a value equal to 1 (at Step S4); subsequently proceed to the step S2, at which an instruction to turn on the indicator 21 will be generated.

When $V_{IMAL} \leqq V_{IMA} \leqq V_{IMAH}$ is satisfied, whether the voltage $V_{IMASEL}$ of the connecting terminal IN2 is greater than or equal to the lower limit value $V_{IMASEL}$ and less than or equal the upper limit value $V_{IMASH}$ or lower is determined (at Step S5). When $V_{IMASEL} < V_{IMASL}$ or $V_{IMASEL} > V_{IMASH}$ is satisfied, this indicates that the voltage is outside of the adjustable range in which a cylinder's quantity of fuel injection is adjusted by operating the rheostat 18 for cylinder designation. Therefore, at the step S4 the adjustment enabling flag FIMA is set to a value equal to 1, and then the operation proceeds to the step S2. When $V_{IMASL} \leqq V_{IMASEL} \leqq V_{IMAHh}$ is satisfied, whether or not the engine 2 is idling is determined (at Step S6). The engine is determined to be running idle when the amount of the throttle valve angle TH obtained from the output of the throttle angle sensor 25 through the A/D converter 12 is not more than the specific amount of the angle, and the engine speed Ne obtained from the output of the counter 9 has been detected to be not higher than the specific engine speed (e.g., 1000 rpm).

When the engine 2 is idling, whether or not the engine coolant temperature Tw is high is determined (at Step S7). When the coolant temperature Tw gained from the output of the coolant temperature sensor 24 through the A/D converter 12 is higher then the specific temperature, the coolant temperature is determined to be high. The specific temperature is a desired temperature for instance after the completion of warm-up of the engine 2. When the engine coolant temperature Tw is high, whether or not the engine 2 is not loaded is determined (at Step S8). The unloaded state of the engine 2 is detected by means of the clutch switch 27 or the neutral switch 28. That is, when the engine 2 is not loaded, the clutch switch 27 detects the clutch is open or the neutral switch 28 detects the transmission is in a neutral position.

Figure 3:
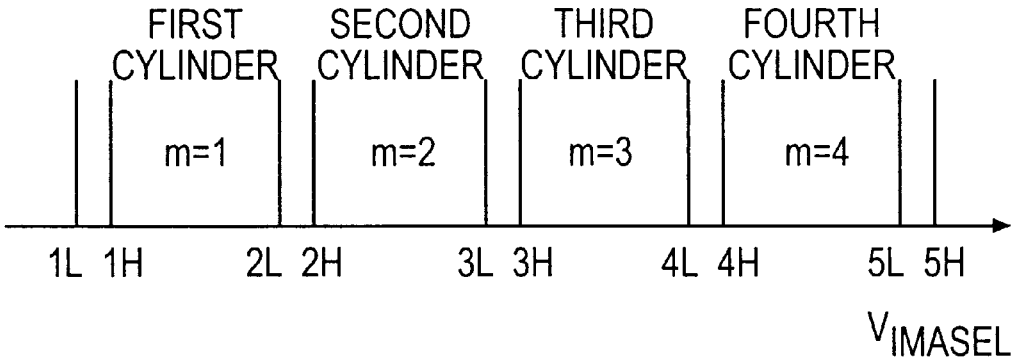
FIG. 3 is a table showing a relationship between the voltage $V_{IMSEL}$ and each cylinder.

When the engine 2 is idling, the engine coolant temperature Tw is high, the engine 2 is in an unloaded state, and a cylinder m corresponding to the voltage $V_{IMASEL}$ of the connecting terminal IN2 is determined (at Step S9). The voltage $V_{IMASEL}$ to the A/D converter 12 from the rheostat 18 through the connecting terminal IN2 varies with the control of the rheostat 18. The relationship between the level of the voltage $V_{IMASEL}$ and the engine cylinder has been preset as shown in FIG. 3, and stored as a cylinder data map in the ROM 8; therefore the CPU 6 determines, by the use of the cylinder data map, the cylinder m corresponding to the level of the voltage $V_{IMASEL}$ that has been read. Threshold voltages of cylinders are added with hysteresis as shown by 1L, 1H to 5L, and 5H respectively as shown in FIG. 3.

Figure 4:
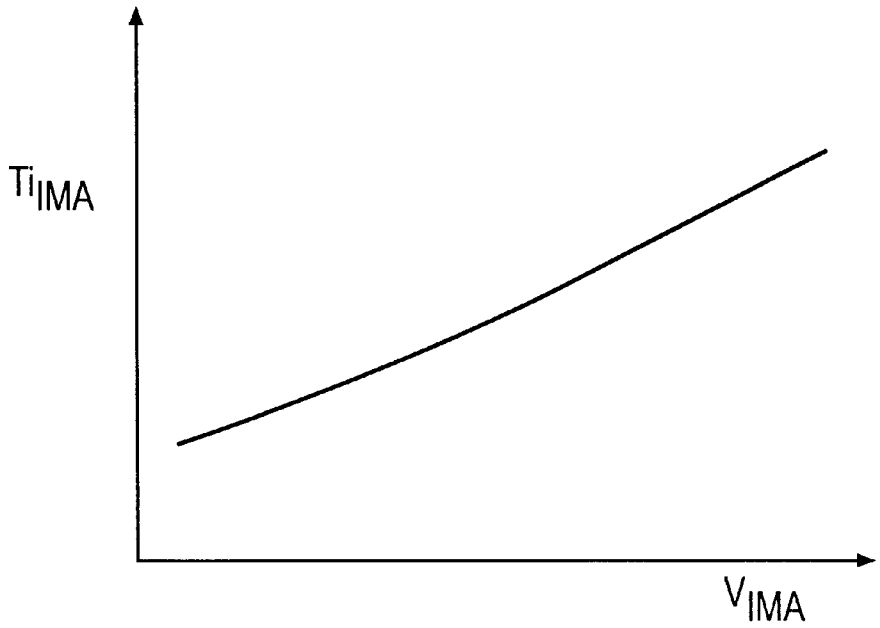
FIG. 4 is a characteristic curve showing a relationship between the voltage $V_{IMA}$ and the corrected value of fuel between cylinders TiIMA.

Upon the determination of the cylinder m, the fuel correction value between cylinders TiIMA(m) corresponding to the level of the voltage $V_{IMA}$ of the connecting terminal IN1 is set (at Step S10). The voltage $V_{IMA}$ supplied to the A/D converter 12 from the rheostat 17 through the connecting terminal varies with the control of the rheostat 17. The relation between the level of the voltage $V_{IMA}$ and the fuel correction value TiIMA between cylinders is a characteristic shown for instance in FIG. 4 which have been pre-stored as a $V_{IMA}$-TiIMA data map. Therefore, at the CPU 6 the fuel correction value between cylinders TiIMA corresponding to the level of the read voltage $V_{IMA}$ is set as TiIMA(m) by using the $V_{IMA}$-TiIMA data map. After completion of setting of the fuel correction value between cylinders TiIMA(m) at the step S10, the CPU 6 generates an ON-OFF instruction to the output interface circuit 10 (at Step S11). This ON-OFF instruction is generated to indicate the cylinder m. The output interface circuit 10, therefore, operates the indicator 21 ON and OFF at an ON-OFF cycle according to the ON-OFF instruction corresponding to the cylinder m. This is the state of ON-OFF indication of the cylinder. The operator will be informed, by the ON-OFF operation of the indicator 21, of the adjustment of fuel injection quantity for the cylinder m.

During the adjustment of the fuel injection quantity, the fuel correction value between cylinders TiIMA(m) set at the step S10 is instantly reflected to the calculation of the fuel injection time Tout in the fuel injection control routine, whereby the operating condition of the engine 2, for instance the engine speed during idling, will vary.

In the meantime, when the engine 2 is not idling, or when the engine coolant temperature Tw is not high, or when the engine 2 is not loaded, the CPU 6 generates an ON-OFF instruction of 50-percent duty ratio to the output interface circuit 10 (at Step S12). The output interface circuit 10 operates the indicator 21 on and off at the 50-percent duty ratio in accordance with the ON-OFF instruction of 50-percent duty ratio. With the ON-OFF operation of the indicator 21 at the 50-percent duty ratio, the operating condition of the engine 2 unsuitable for the adjustment of fuel injection quantity is informed to the operator by the 50-percent duty ratio ON-OFF operation of the indicator 21. When the memory writing switch 15 is operated by the operator during adjustment of the fuel injection quantity, the memory writing operation is executed by the interrupt process at the CPU 6.

Figures 5, 6:
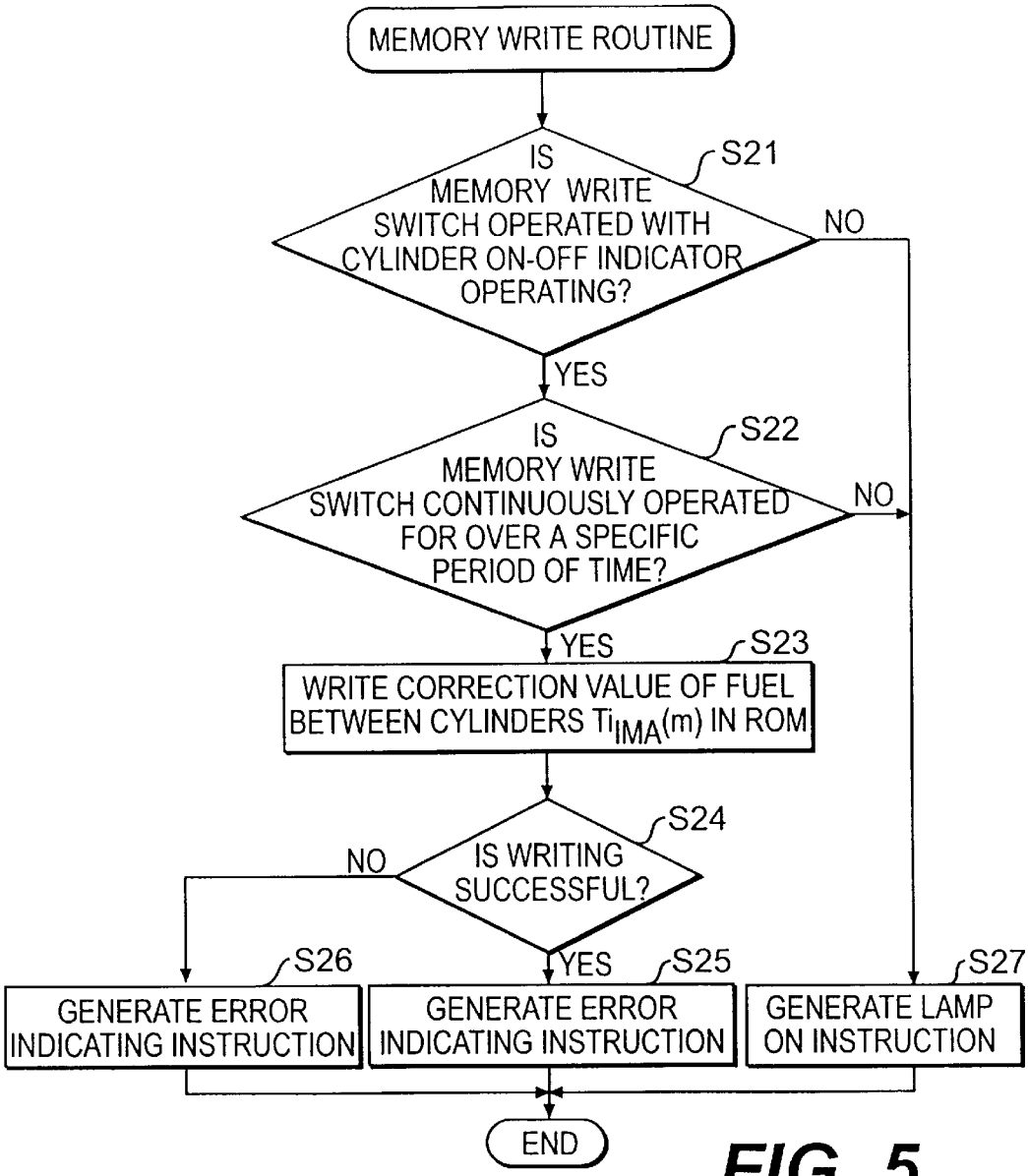
FIG. 5 is a flowchart showing a memory writing routine.
FIG. 6 is a table showing a TiIMA(m) data map.

In the memory writing operation, the CPU 6 determines whether or not the memory writing switch 15 has been operated when the cylinder ON-OFF lamp on the indicator 21 is operating as shown in FIG. 5 (at Step S21). This means that the fuel correction value between cylinders TiMA is newly set by the fuel injection quantity adjustment when the cylinder ON-OFF lamp is operating at the step S11, to thereby perform memory writing though restricted only to the above-described case. Upon operation of the memory writing switch 15 when the cylinder ON-OFF lamp is operating, it is determined whether or not the memory writing switch 15 has been continuously operated over a specific period of time (e.g., 1 sec.) (at Step S22). When the memory writing switch 15 has been continuously operated over the specific period of time, the fuel correction value between cylinders TiIMA(m) set at Step S10 will be written in the TiIMA(m) data map of the ROM 8 (at Step S23). In the TiIMA(m) data map, the fuel correction value TiIMA(m) is written as T1 to T4 for respective cylinders as shown in FIG. 6.

After the execution of step S23, the CPU 6 determines whether or not the writing of the fuel correction value TiIMA(m) was successful (Step S24). This is accomplished by reading the fuel correction value TiIMA(m) entered into the ROM 8, comparing this value with the fuel correction value between cylinders TiIMA(m) of the cylinder m that has been set at Step S10, and by confirming the agreement of these values. Upon a success in writing the fuel correction value between cylinders TiIMA(m), a success indicating instruction is generated for the output interface circuit 10 (Step S25). The output interface circuit 10 turns on the indicator 21 only for two seconds according to the success indicating instruction, and subsequently the indicator 21 turns on and off at a specific ON-OFF cycle according to the cylinder m. The operator can see by the two-second ON-OFF operation of the indicator 21 that the writing of the fuel adjusting data of the cylinder m, that is, the writing of the fuel correction value between cylinders TiIMA(m) is successful. In the meantime, if the writing of the fuel correction value between cylinders TiIMA(m) is unsuccessful, an error indicating instruction is generated to the output interface circuit 10 (Step S26). The output interface circuit 10 operates on and off at a relatively long specific cycle in accordance with the error indicating instruction, thereby informing the operator of a failure in the writing of the fuel adjusting data of the cylinder m, that is, in the writing of the fuel correction value between cylinders TiIMA(m).

When it has been determined at Step S21 that the memory writing switch is not operated in the cylinder ON-OFF state, or at Step s22 that the memory writing switch has not been operated over a specific period of time, an instruction to turn on the indicator 21 is generated to the output interface circuit 10 (Step S27). The output interface circuit 10 functions to light up the indicator 21 in accordance with an ON instruction, thereby informing the operator of the condition that the memory cannot be written.

It is to be noticed that in the above-described embodiment, the rheostats 17 and 18 are used as the first and second variable control devices respectively, but the present invention is not limited thereto and there may be adopted such a constitution that the count of the up-down counter is increased or decreased in accordance with switch operation.

The indicator 21 lights up or makes ON-OFF operation at a specific cycle to indicate adjusting condition and a designated cylinder, but the adjusting condition and the designated cylinder may be indicated by the use of numerals and characters.

Furthermore, the ROM 8 to be employed is for instance an EEP-ROM, which, however, is not limited thereto.

According to the present invention, as described above, the quantity of fuel injection per cylinder is calculated according to the engine operation parameters of the internal combustion engine. Any one of the multicylinders is selectively designated in accordance with the output of the first variable control device. An adjustment data indicating the amount of adjustment of the fuel injection quantity is generated in accordance with the output of the second variable control section. When the fuel injection quantity corresponding to the designated one cylinder in the mode of fuel adjustment between cylinders is calculated, the quantity of fuel injection is corrected according to the adjustment data, and the thus corrected fuel quantity to be injected is injected into the designated one cylinder. That is, since the cylinder designated in accordance with the control of the first variable control section changes and the amount of adjustment of fuel injection quantity indicated by the adjustment data in accordance with the control of the second variable control section varies, it is possible to set, in the mode of fuel adjustment between cylinders, the amount of adjustment of the fuel injection quantity for every cylinder simply by operating the two variable control sections as a result of corrections of the fuel injection quantity in accordance with the adjustment data. Thus it is possible to adjust the quantity of fuel injection between cylinders by using the fewest possible number of variable control sections.

Furthermore, according to the fuel injection control apparatus of the present invention, the adjustment data acquired by each cylinder in the mode of fuel adjustment between cylinders is stored as a data map by each cylinder. Therefore it is possible to properly reflect the adjustment data gained in the mode of fuel adjustment between cylinders to the quantity of fuel injection by each cylinder in the subsequent engine operation mode.

Furthermore, according to the fuel injection control apparatus of the present invention, when an adjusting data corresponding to one cylinder designated by a cylinder designating means in the mode of fuel adjustment between cylinders, there is provided an indicator which indicates the designated one cylinder; and therefore the operator will be informed of which one of the cylinders is under adjustment, from details of indication, and therefore can easily make the adjustment of fuel injection quantity.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A fuel injection control apparatus for controlling the quantity of fuel to be injected into each cylinder of a multicylinder internal combustion engine, comprising:

a fuel injection quantity calculating means for calculating the quantity of fuel to be injected into each cylinder of said internal combustion engine in accordance with engine operation parameters;

a cylinder designating means for selectively designating any one cylinder of said multicylinder internal combustion engine in accordance with an output of a first variable control device;

an adjustment quantity designating means for generating fuel adjusting data which indicate an amount of adjustment of fuel injection in accordance with an output of a second variable control device;

a fuel injection quantity correcting means for correcting the quantity of fuel to be injected in accordance with the fuel adjusting data generated by said adjustment quantity designating means; and a means for injecting into said one designated cylinder the corrected fuel quantity that has been corrected by said injection quantity correcting means.

2. The fuel injection control apparatus of a multicylinder internal combustion engine according to claim 1, wherein means for writing in a memory an adjusting data as a data map corresponding to one cylinder designated by said cylinder designating means at the time the adjusting data is gained is provided; said data map being generated by said adjustment quantity designating means in said mode of fuel adjustment between cylinders; and said injection quantity correcting means reads, from said data map, the adjusting data corresponding to each cylinder in other engine operation mode than said mode of fuel adjustment between cylinders, thereby correcting the fuel injection quantity calculated by said fuel injection quantity calculating means in accordance with the adjusting data thus read.

3. The fuel injection control apparatus of a multicylinder internal combustion engine according to claim 1, further including an indicator which indicates one designated cylinder when an adjusting data for one cylinder designated by said cylinder designating means in said mode of fuel adjustment between cylinders is given by said adjustment quantity designating means.

4. The fuel injection control apparatus of a multicylinder internal combustion engine according to claim 1, wherein said first variable control device comprises a rheostat.

5. The fuel injection control apparatus of a multicylinder internal combustion engine according to claim 1, wherein said second variable control device comprises a rheostat.

6. The fuel injection control apparatus of a multicylinder internal combustion engine according to claim 1, wherein said first variable control device and said second variable control device each comprise a rheostat.

7. The fuel injection control apparatus of a multicylinder internal combustion engine according to claim 6, wherein said first variable control device and said second variable control device are removably connected to an A/D converter, said A/D converter provided to convert analog inputs from engine operating operating parameters into digital signals from analog inputs.

8. The fuel injection control apparatus of a multicylinder internal combustion engine according to claim 7, further comprises an electronic control unit including a CPU, a RAM, a ROM, a counter, an output interface (I/F) circuit, an input interface circuit, and said A/D converter.

9. A fuel injection control apparatus for controlling the quantity of fuel to be injected into each cylinder of a multicylinder internal combustion engine, comprising:

a fuel injection quantity calculating means for calculating the quantity of fuel to be injected into each cylinder of said internal combustion engine in accordance with predetermined engine operation parameters;

a cylinder designating means for selectively designating any one cylinder of said internal combustion engine in accordance with an output of a first variable control device;

an adjustment quantity designating means for generating fuel adjusting data for indicating the amount of adjustment of fuel injection in accordance with an output of a second variable control device; and means for injecting into said one designated cylinder the corrected fuel quantity that has been corrected based on said adjusting data.

10. The fuel injection control apparatus of a multicylinder internal combustion engine according to claim 9, further including a fuel injection quantity correcting means for correcting the quantity of fuel to be injected in accordance with the fuel adjusting data generated by said adjustment quantity designating means when the fuel injection quantity has been calculated by said fuel injection quantity calculating means for one cylinder designated by said cylinder designating means in a mode of fuel adjustment between cylinders.

11. The fuel injection control apparatus of a multicylinder internal combustion engine according to claim 9, wherein means for writing in a memory an adjusting data as a data map corresponding to one cylinder designated by said cylinder designating means at the time the adjusting data is gained is provided; said data map being generated by said adjustment quantity designating means in said mode of fuel adjustment between cylinders; and said injection quantity correcting means reads, from said data map, the adjusting data corresponding to each cylinder in an engine operation mode other than said mode of fuel adjustment between cylinders, thereby correcting the fuel injection quantity calculated by said fuel injection quantity calculating means in accordance with the adjusting data thus read.

12. The fuel injection control apparatus of a multicylinder internal combustion engine according to claim 9, and further including an indicator which indicates one designated cylinder when an adjusting data for one cylinder designated by said cylinder designating means in said mode of fuel adjustment between cylinders is given by said adjustment quantity designating means.

13. The fuel injection control apparatus of a multicylinder internal combustion engine according to claim 9, wherein said first variable control device comprises a rheostat.

14. The fuel injection control apparatus of a multicylinder internal combustion engine according to claim 9, wherein said second variable control device comprises a rheostat.

15. The fuel injection control apparatus of a multicylinder internal combustion engine according to claim 9, wherein said first variable control device and said second variable control device each comprise a rheostat.

16. The fuel injection control apparatus of a multicylinder internal combustion engine according to claim 15, wherein said first variable control device and said second variable control device are removably connected to an A/D converter, said A/D converter provided to convert analog inputs from engine operating operating parameters into digital signals from analog inputs.

17. The fuel injection control apparatus of a multicylinder internal combustion engine according to claim 16, further comprises an electronic control unit including a CPU, a RAM, a ROM, a counter, an output interface (I/F) circuit, an input interface circuit, and said A/D converter.

* * * * *